United States Patent [19]
Gablin et al.
[11] 4,100,860
[45] Jul. 18, 1978

[54] SAFE TRANSPORATION OF HAZARDOUS MATERIALS

[75] Inventors: Kenneth A. Gablin, Burton; Larry J. Hansen, Tacoma, both of Wash.

[73] Assignee: Nuclear Engineering Co., Inc., Louisville, Ky.

[21] Appl. No.: 418,928

[22] Filed: Nov. 26, 1973

Related U.S. Application Data

[63] Continuation of Ser. No. 171,713, Aug. 13, 1971, abandoned.

[51] Int. Cl.[2] ..... E04B 2/02; B65D 25/18

[52] U.S. Cl. ..... 109/83; 109/49.5; 109/23 R; 220/444

[58] Field of Search ..... 109/82, 79, 80, 84, 109/49.5, 58.5, 24, 23, 29; 220/1.5, 5 A, 55 D, 55 E, 55 F, 9 F; 428/305-315; 161/166, 159, 161

[56] References Cited

U.S. PATENT DOCUMENTS

| | | | |
|---|---|---|---|
| 1,606,846 | 11/1926 | Smith | 220/1.5 |
| 1,749,222 | 3/1930 | Merrian | 109/84 |
| 3,044,161 | 7/1962 | Morrison | 220/9 F X |
| 3,177,271 | 4/1965 | Slayman | 264/45.3 |
| 3,444,280 | 5/1969 | Pulaski | 264/46.5 |
| 3,489,477 | 1/1970 | Harder | 220/9 R X |
| 3,517,850 | 6/1970 | Von Saldern et al. | 220/9 R |
| 3,655,087 | 4/1972 | Luisada | 220/1.5 |
| 3,657,036 | 4/1972 | Mullenhoff et al. | 161/166 X |
| 3,668,031 | 6/1972 | Bast | 161/166 |
| 3,749,273 | 7/1973 | Wreghitt et al. | 220/1.5 |
| 3,755,063 | 8/1973 | Massey et al. | 161/161 |
| 3,815,657 | 6/1974 | Malek et al. | 160/201 X |
| 3,816,233 | 6/1974 | Powers | 161/166 |

*Primary Examiner*—Dennis L. Taylor
*Attorney, Agent, or Firm*—Schapp and Hatch

[57] ABSTRACT

A shipping container overpack for safe transportation of radioactive and other hazardous materials provides a leakproof receptacle for containing and protecting the material to be shipped against accidental release and dispersal into the surrounding environment. The receptacle is of conventional size and shape for shipping containers and has spaced inner and outer shells with a layer of foamed polyurethane occupying the space therebetween to provide sealing, insulation and reinforcement. The polyurethane foam is rigidly compressible and adheres to and reinforces the spaced inner and outer shells to provide a stress skin structure. Gusset plates are secured to the inner surface of the outer shell in covering relation to the corners and edges, defining a reinforcing framework of triangular cross-section tubular elements. Relatively rigid polyurethane foam is containd within the tubular elements to add further reinforcement and redundant sealing capacity.

Penetration is resisted by making the outer shell of relatively ductile metal adapted to deform and absorb energy rather than permit penetration. Deformable slip plates back up large flat areas of the outer shell, providing increased resistance to penetration. Orifices are provided in the outer shell so that the effects of excessive heat applied to the outer shell, as by a surrounding fire, are reduced by formation of a gas, caused by heat decomposition of the polyurethane foam, flowing in a layer just under the outer shell to provide insulation and carry off heat, with the expulsion of such gases through the orifices being of sufficient force to ensure that combustion of the expelled gases takes place a spaced distance from the outside shell.

A method of fabricating the receptacle is disclosed in which a liquid isocyanate is mixed with a liquid curing agent and a liquid blowing agent and poured into the space between the inner and outer shell. The reaction of the curing agent with the isocyanate generates heat sufficient to vaporize the blowing agent causing the foam to be formed and cured in place. The heat sink effect of the metal shells reduces the foaming action thereat so that the foam material is of higher average density adjacent to the shells than it is is remote from the shells.

The receptacle is formed in sections and is provided with a gasket for sealing the material to be shipped therewithin. In one form of the invention, the receptacle has the usual fittings and is of the size and shape of a conventional shipping container, of the type used for carrying cargo in seagoing vessels, and is formed with a box-like section and a lid section hinged thereon. In another form of the invention, the receptacle is cylindrical shaped to accommodate a conventional lead radiation shielding container, and is transected medially of its length to provide access.

28 Claims, 21 Drawing Figures

SAFE TRANSPORATION OF HAZARDOUS MATERIALS

This is a continuation of application Ser. No. 171,713, filed Aug. 13, 1971 now abandoned.

BACKGROUND OF THE INVENTION

This invention relates to *SAFE TRANSPORTATION OF HAZARDOUS MATERIALS,* and more particularly to a method and apparatus for fabricating shipping container protective overpacks capable of preserving their leakproof integrity and preventing dispersal of the contents in the event of various types of accidents.

While various types of containers are known for shipping perishable and fragile commodities, the increasingly widespread use of radioactive and other extremely hazardous materials has presented problems not adequately solved by known types of shipping containers. Where the materials being shipped are capable of extreme contamination of the surrounding environment, if allowed to escape and disperse, the limited protective and non-leaking capabilities of conventional containers are completely inadequate.

Although known types of shipping containers possibly could be employed for transporting extremely hazardous materials under normal conditions, the trucks, ships and other carriers utilized to transport the containers unfortunately are subject to accidents capable of damaging and rupturing conventional containers sufficiently to allow scattering and dispersal of their contents. This present and ever increasing danger is exemplified in the Hazardous Materials Regulations of the United States Department of Transportation, which impose increasingly stringent requirements for fissile radioactive material shipments.

Not only must the shipping container be capable of preserving leak-proof integrity and preventing dispersal, but it must do so under extreme conditions of impact, shock, fire and other violent forces which may be encountered should the carrier be involved in an accident. Thus, the container must be able to resist breakage and rupture from shock or collision, it must resist penetration by elongated objects, and it must protect against the effects of surrounding fire.

SUMMARY OF THE INVENTION

The present invention contemplates a receptacle which can be utilized as a shipping container or an overpack for other containers. The receptacle has an extremely high strength to weight ratio, while still providing effective protection against accidental dispersal of the contents, even under extreme conditions. Basically, the receptacle is formed in a plurality of sections, releasably sealed together to provide a leak-proof structure. The walls of the receptacle are of laminar construction affording a leakproof inner liner or shell, an outer shell spaced from the inner liner, and a layer of insulating material sandwiched between the inner and outer shells, with the insulating material being adhered to the inner and outer shells to provide a stress skin structure.

Leakage of the contents is prevented by the resistance of the wall structure to rupture and perforation, and also by the layer of cellular insulating material occupying the space between the inner and outer shells and adhered thereto. The wall structure provides redundant reinforcement and sealing of the outer shell at areas most likely to be split or perforated during an accident.

The contents of the receptacle, including any containers placed therein, are protected against shock, rupturing, penetration, excessive heat, freezing, etc. This further enhances the leak-proof qualities of the receptacle and insures that even the most rigid shipping regulations, for even the most hazardous materials, can be met by the very strong and light-weight structure herein provided.

Use of the present invention in transporting hazardous materials, or materials requiring a high degree of protection, is facilitated by the adaptability of the receptacle to production in standardized shapes and sizes similar to the shapes and sizes of shipping containers presently in use. For example, one form of the invention is particularly adapted to be outwardly similar to a standard international shipping container of the type that can be seen at any major dock in the world handling large quantities of freight. In addition, this form of the invention is intermodal, i.e. standard cast iron corners used in all ISO standard cargo containers fit corresponding protruding lug attachments on trucks, railroad flat cars, ships and even large cargo aircraft. Because of the standard size and corner fittings, stacking is not a problem and the device of the present invention can be handled by standard cargo container handling and securing equipment.

Because of its superior shock insulation and leakproof qualities, the shipping container overpack of the present invention makes it possible to transport and/or store economically certain equipment and materials which heretofore often have been destroyed or otherwise disposed of because of shipping difficulty and high expense. Thus, many obsolete lead pigs now sitting idle at Atomic Energy Commission facilities can be used with the overpack of the present invention. Also, other casks deemed obsolete by recent Department of Transportation Regulations can regain utility. Moreover, the overpack of the present invention can also be act as a container for warehouse storage or shipboard stowage. The described wall structure is capable of protecting the contents for relatively long periods of time under extreme thermal conditions, such as those encountered in a warehouse fire. In addition, the cellular material serves as a shock absorber and insulator and protects liquids from freezing in winter extremes during shipment or storage. Thus, the container of the present invention can prevent such disasters as widespread dispersal of highly radioactive material, munitions fires on board ships, release into the environment of nerve gas or other CBR agents, and similar high risk events.

The method of the present invention makes it possible to provide the cellular insulating layer in a single, integral body completely filling the space between the inner and outer shells and firmly adhered to these shells at all points of contact. Also, the method of the present invention makes it possible to graduate the average density of the insulating layer from shell to shell in such manner that less cells or voids are formed adjacent to the shells than are formed in areas remote therefrom, and this provides localized control of reinforcement characteristics.

Accordingly, it is a principle object of the invention to provide a protective container overpack for safe transportation and storage of hazardous materials and the like.

Another object of the present invention is to provide a device of the character described which has a high strength to weight ratio and may be produced in standard sizes and configurations heretofore used for shipping containers.

A further object of the invention is to provide a device of the character described which is leak-proof and capable of confining the contents and preventing dispersal thereof through the surrounding environment, even under extreme conditions as may be encountered during an accident to a cargo carrier.

A still further object of the invention is to provide a device of the character set forth which is extremely resistant to damage and rupture by impact or penetration Another object of the invention is to provide a shipping container overpack of the character described which is capable of providing both thermal and shock insulation to its contents, and which will not rupture or leak under extreme conditions such as being immersed in fire.

Yet another object of the present invention is to provide a strong and lightweight shipping container overpack of the character set forth which is economical and simple to manufacture and use.

Another object of the present invention is to provide a laminated wall structure incorporating a rigidly compressible insulating foam layer sandwiched between a leak-proof inner layer and a ductile outer layer, the structure being capable of spreading and absorbing concentrated forces from an object attempting to penetrate the wall structure.

A further object of the present invention is to provide a method for manufacturing the described shipping container overpack in a rapid and efficient manner not requiring a high degree of skill or large amounts of equipment.

Other objects and features of advantage will become apparent from the following specification and from the claims.

Figure 1:
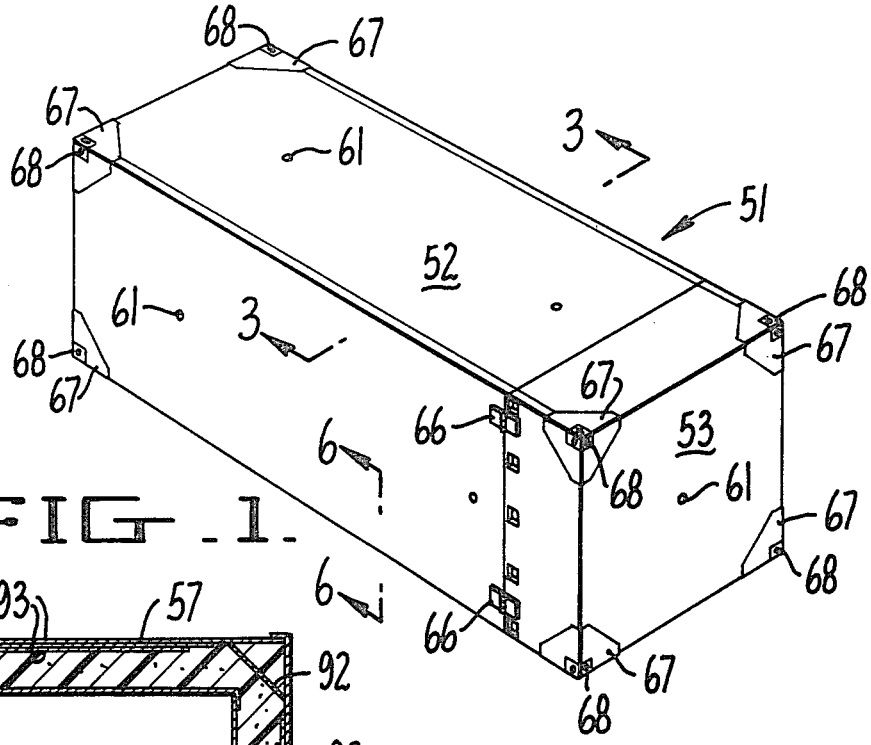
FIG. 1 is a perspective view of a shipping container overpack constructed in accordance with the present invention.
Figure 3:
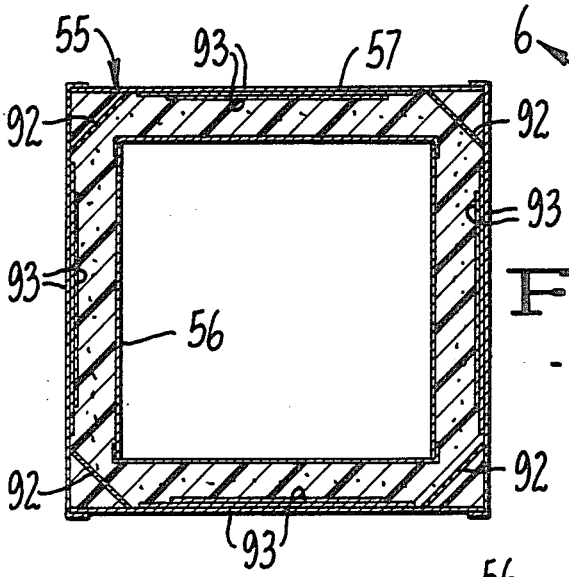
FIG. 3 is an enlarged vertical cross-sectional view taken substantially on the plane of line 3—3 of FIG. 1.
Figure 2:
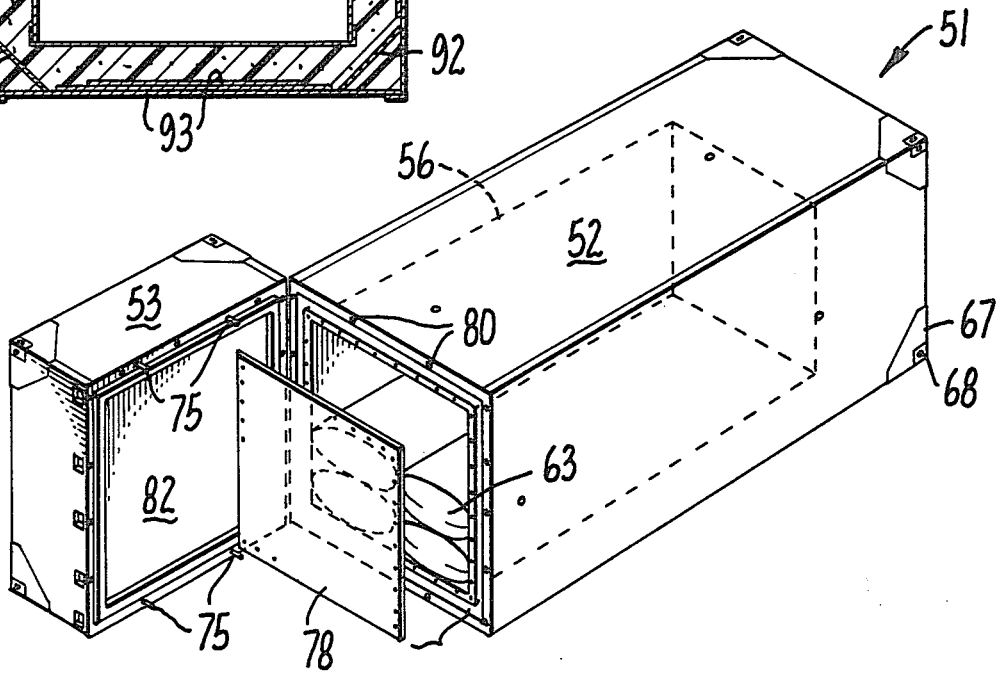
FIG. 2 is a perspective view of the shipping container overpack of FIG. 1, with a lid section swung open and an internal panel dismounted for loading of cargo.
Figure 4:
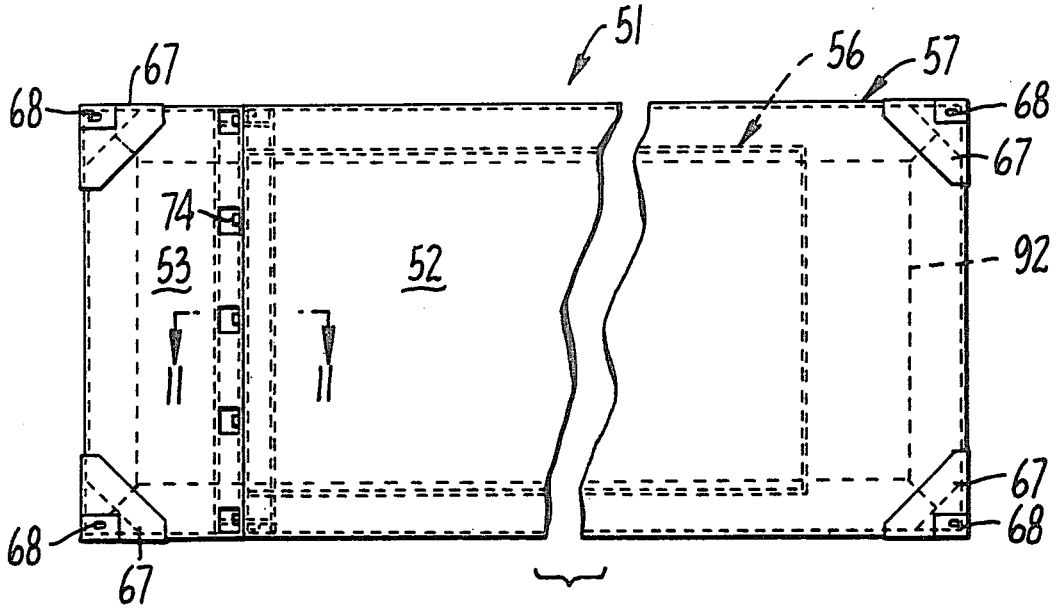
FIG. 4 is a side elevational view, partially broken away, of the shipping container overpack of FIG. 1.
Figure 5:
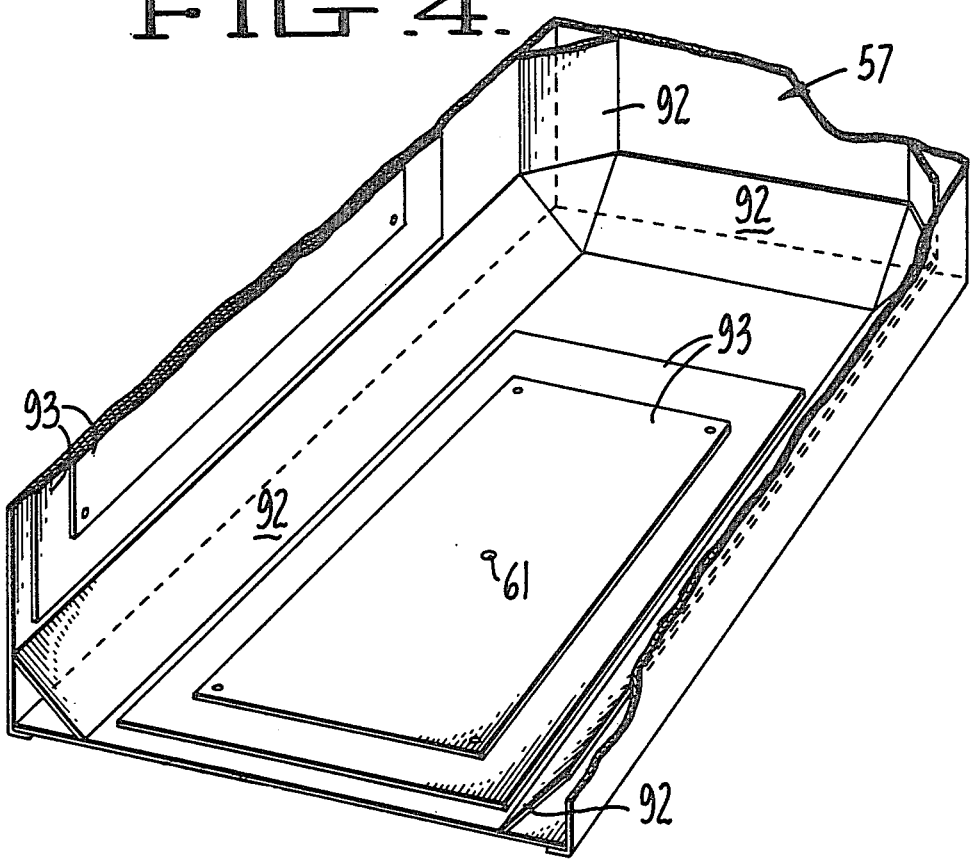
FIG. 5 is a perspective view, on an enlarged scale, of the shipping container overpack of FIG. 1, with portions being broken away and shown in section to illustrate details of internal construction.
Figure 6:
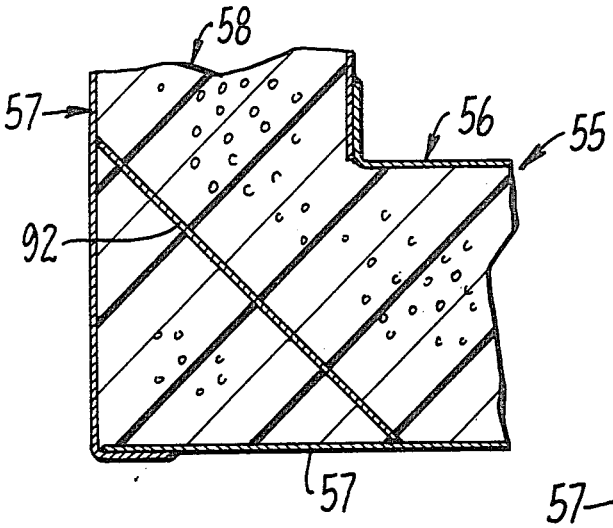
FIG. 6 is an enlarged fragmentary sectional view taken substantially on the plane of lines 6—6 of FIG. 1 and illustrating a preferred corner construction.
Figure 7:
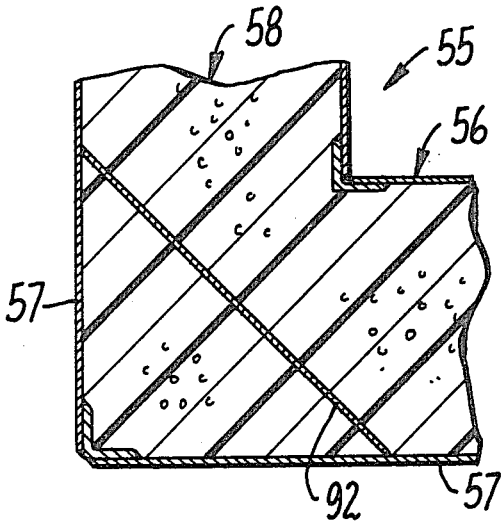
FIG. 7 is a view similar to that of FIG. 6, but illustrating an alternate corner construction.
Figure 8:
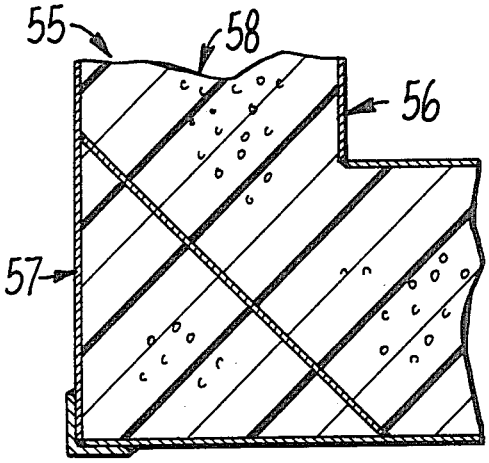
FIG. 8 is a view similar to that of FIG. 7, but showing another alternate corner construction.
Figure 10:
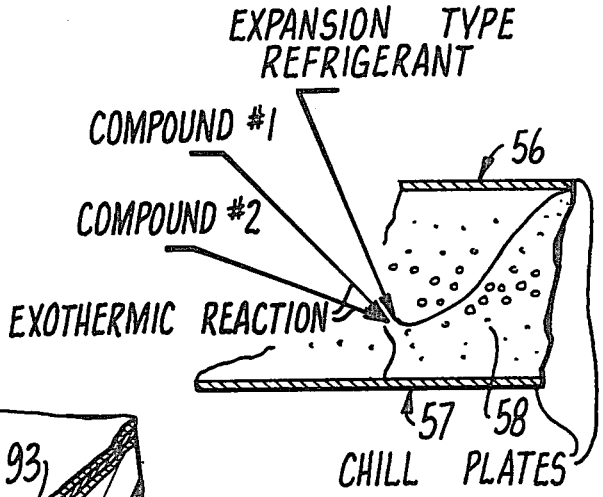
FIG. 10 is a diagrammatic representation of a section of wall structure made in accordance with the present invention and illustrating the formation of an insulating interlayer of varying average density.
Figure 9:
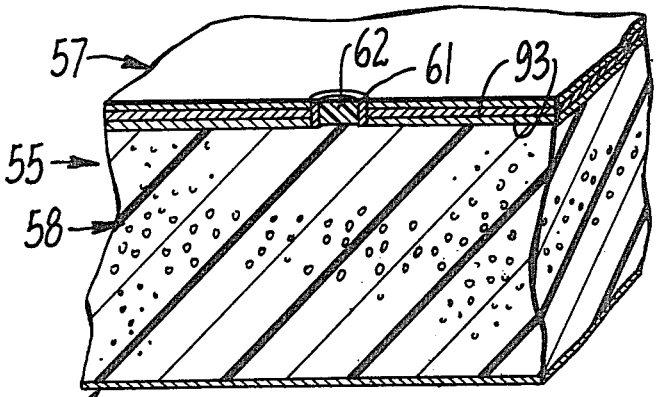
FIG. 9 is a perspective view of a wall structure formed in accordance with the present invention, with portions thereof being broken away and shown in section for clarification of construction.

While only the preferred forms of the invention have been shown in the drawings, it will be apparent that changes and modifications could be made thereto within the ambit of the invention as defined in the claims.

DESCRIPTION OF THE PREFERRED EMBODIMENTS

Referring to the drawings in detail, it will be seen that the shipping container overpack of the present invention essentially consists of a receptacle 51 comprising a plurality of sections 52 and 53, and means 54 for releasably sealing the sections together to provide a leak-proof container overpack, the sections 52 and 53 being defined by laminated wall structures 55 having spaced inner and outer layers 56 and 57 and a layer 58 of cellular insulating material sandwiched between and adhered to the confronting surfaces of layers 56 and 57.

In accordance with the invention, layers 56 and 57 are relatively dense and tough and are adhered to the opposite sides of a less dense and tough layer 58 of cellular insulating material to provide a stress skin structure. The term "stress skin" stems from the early days of aviation when structural engineers found that the fabric or skin which formed the airfoil surface could be stressed between the ribs of the wing to form a very light but strong surface, since the skin was stressed at the point where it was most efficient. The laminated wall structures 55 are extremely strong and rigid, in comparison to their weight, because of the reinforcing interaction between the rigidly compressible cellular insulating material 58 and and the more dense and tough layers 56 and 57 with which it is laminated.

In order to guard against accidental scattering and dispersion of the contents of receptacle 51 by breaching of the leak-proof inner liner 56, the outer shell 57 is deformable and is constructed to absorb energy and spread localized forces acting on the outer shell 57, as would be encountered in case of accident to the carrier. Besides providing the strength and rigidity of a stress skin structure, the laminated wall structures 55, and especially the rigidly compressible cellular insulating material 58, protect the integrity of the inner liner against both crushing impact of collision or dropping and/or penetration by relatively sharp objects.

Basically, the ability of the shipping container overpack of the present invention to protect the inner liner 56 and its contents derives from diffusing the force of impact, or the force exerted by the penetrating object, through absorption of energy required to deform the outer shell 57 and crush the volume of cellular insulating material 58. When a penetrating object 59 forceably encounters the shipping container overpack, the outer shell 57 bends inwardly against increasing resistance of the cellular material 58, which tends to be crushed in an expanding cone of deformation. This produces a cushioning effect which slows down and halts the relative movement of the penetrating object without breaching the outer shell 57.

In order to accommodate the described deformation of the outer shell 57 without rupturing, the shell should be fabricated of a yieldable or ductile material. As here shown, the outer shell 57 is fabricated from very ductile low-carbon steel plate approximately 3/16th of an inch thick. The elongation of this material is nearly 40%, thus allowing the outer shell 57 to undergo large deformations without fracturing. Since energy is required to produce these distortions, the shell 57 will be capable of absorbing a large amount of energy, in addition to the energy absorbed by the cellular material 58. Also, energy may be dissipated at the interface between the outer shell 57 and the adhered cellular material 58.

In accordance with the present invention, the layer 58 of cellular insulation is preferably formed in a unitary body of rigidly compressible foam material occupying substantially all of the space between the inner liner 56 and outer shell 57. To provide the unitary body, the material 58 is foamed in situ between the inner liner 56 and outer shell 57. Basically, this is accomplished by mixing a liquid polymerizable material with a liquid curing agent and a liquid blowing material, pouring the mixture into the space between the inner liner 56 and outer shell 57, and allowing the mixture to foam up and polymerize in such space.

As a feature of the present invention, the foam material 58 consists of a relatively rigid polyurethane foam. The cellular structure of rigid urethane gives it exceptional strength for its light weight. Compressive strength can be varied from 25 PSI to over 500 PSI through alteration of formulation. The closed cells, in addition to contributing to the strength, also seal the foam against penetration of gases or liquid. Gas contained in the cells not only shapes the cells but also contributes greatly to the thermal insulating capabilities.

Rigid urethane foam is a most efficient insulating material. It has twice the insulating ability of the next best material, polystyrene foam. It is possible to have $k$ factors of 0.1 BTU/hr/ft$^2$ per ° F/inch.

To form the polyurethane foam material 58 in situ, as described, a liquid polyisocyanate is mixed with a liquid polyol and a liquid blowing agent, and the mixture is poured into the space between the inner liner 56 and outer shell 57. The polymerizing reaction is exothermic, generating heat sufficient to cause the blowing agent to vaporize and form tiny bubbles. The formation of these bubbles affords the foaming action which expands the mixture to completely fill the space between the inner liner 56 and outer shell 57 in a few minutes. The materials chosen for the inner liner 56 and outer shell 57 are such that the expanding foam rigidly bonds to all surfaces exposed to the space between the inner liner and outer shell, forcing the latter to work together with the adhered polyurethane foam to provide the abovementioned stress-skin type design.

The liquid blowing agent utilized in the mixture to cause the described foaming action should be chosen from those materials which are liquid at ambient temperatures when mixed with the other liquid components, and which boil as the temperature of the mixture is raised by the exothermic heat of the reaction. A suitable blowing agent is trichloromonofluormethane, also commonly known as refrigerant-11.

Preferably, and as here shown, both the inner liner 56 and outer shell 57 are fabricated from metal. This provides several advantages. The metal surfaces bond readily to the foam mixture as it expands, and the conductivity of the metal provides a "heat sink" effect, which is utilized to vary the density of the foam material 58 in desired areas. Because of absorption of the exothermic heat by the inner liner 56 and outer shell 57, the adjacent polyurethane does not heat up enough to vaporize the blowing agent and hence contains fewer bubbles than the areas remote from the metal surfaces. Thus, the average density of the polyurethane varies across the thickness of the layer, having substantially no cells or voids at the interface with the inner liner 56 and outer shell 57 and many cells or voids per unit volume in the medial areas. This construction provides increased crush strength at and near the metal portions of the structure.

Since the rigidly compressible foam 58 absorbs shock, due to the fact that it deforms, the shock load that one unit volume will absorb is approximately proportional to the density of the foam; i.e., 10-pound density foam will absorb much more energy in deforming than will 2-pound density foam. Because of this difference, heavy foam is used where space (volume) is at a premium to absorb the entire shock load. As an example, the edges of the receptacle 51 represent a very small percentage of the overall volume, while the flat sides represent a large volume of foam. In such case, it is desirable to provide a relatively high density foam at the edges because there is little volume for resisting deformation by collision or impact.

Because collision impacts could by change be imposed on an edge of the receptacle, relatively high density foam is used along the edges to increase the ability of the edge to withstand deformation beyond allowable limits. On the other hand, it the impact occurs on a flat side of the receptacle 51, a relatively large volume of foam 58 resists the load and a lighter density foam may be used in this location. The end result is a very light weight container having increased rigidity in areas requiring same.

In addition to the varying density afforded by the heat sink effect previously described, the density of the foam 58 may be increased at desired locations to provide increased strength by varying the mixture of liquid components; and in particular, by reducing the proportion of the liquid blowing agent relative to the other liquids.

As another important feature of the invention, the ability of the receptacle 51 to maintain its operative integrety and protect its contents when subjected to tremendous quantities of heat, such as would be encountered from burning gasoline, etc., during an accident to the carrier, is greatly increased by the physical nature of the polyurethane foam 58 and the surrounding elements incorporated into the wall structures 55. Upon exposure of the receptacle 51 to such excessive heat, the polyurethane foam 58 decomposes as most polymers do, forming gases, liquids, and solid charred carbon. The charred material remains in the same place, the liquid runs to the lower part of the wall structures 55, and the gases are expelled through vent orifices 61 in the outer shell 57 with sufficient velocity that combustion of the gases occurs a spaced distance away from the outer shell. The pressure inside the wall structure 55 created by the rapid formation of the gases provides a rate of flow through the orifices 61 high enough that the flame cone 60 is always outside of the wall structures simply because not enough oxygen can blend into the gases to support combustion any closer. While the orifices 61 are normally sealed off by the foam 58, a plug 62 of heat degradable material, such as a thermoplastic, i.e., polyethelene may be mounted across each orifice to afford a smooth appearance.

Figure 14:
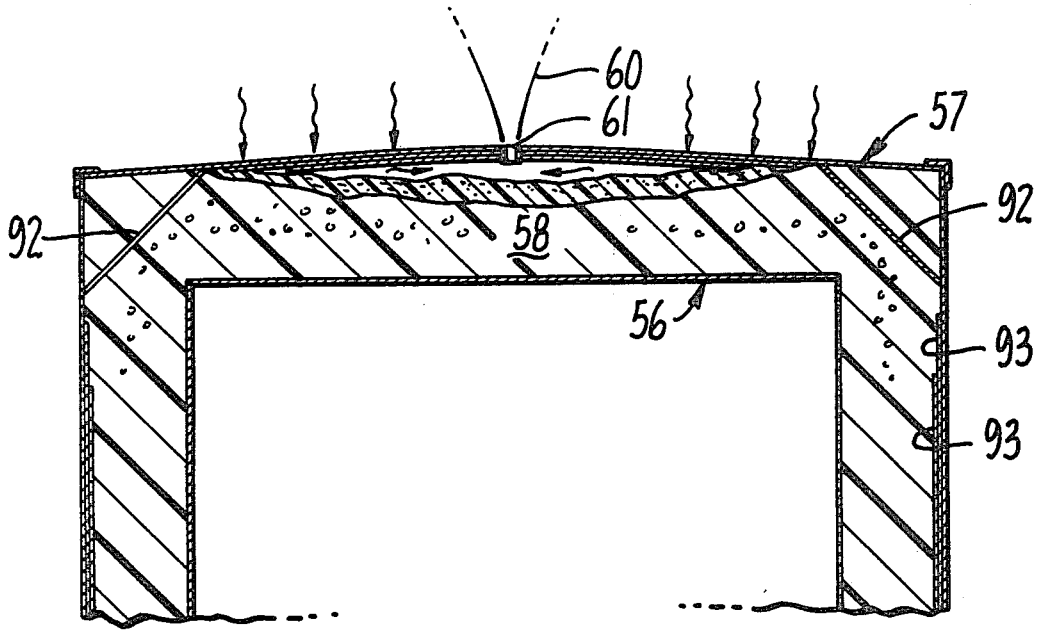
FIG. 14 is a fragmentary sectional view through a portion of the shipping container overpack of FIG. 1 and illustrating the action of the structure when subjected to excessive external heat.
Figure 15:
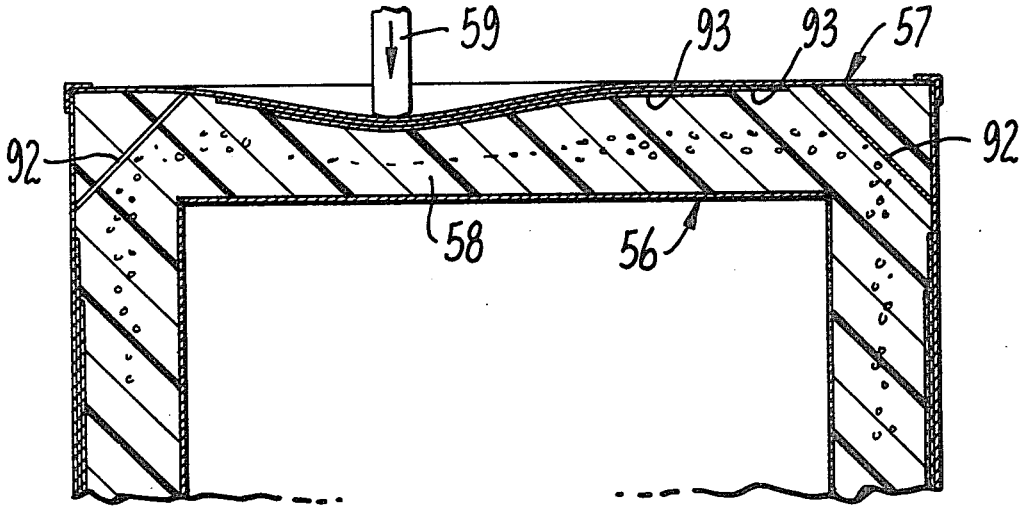
FIG. 15 is a fragmentary sectional view through a typical portion of the shipping container overpack of FIG. 1 and illustrating the action of the structure when resisting penetration by an external object.
Figure 16:
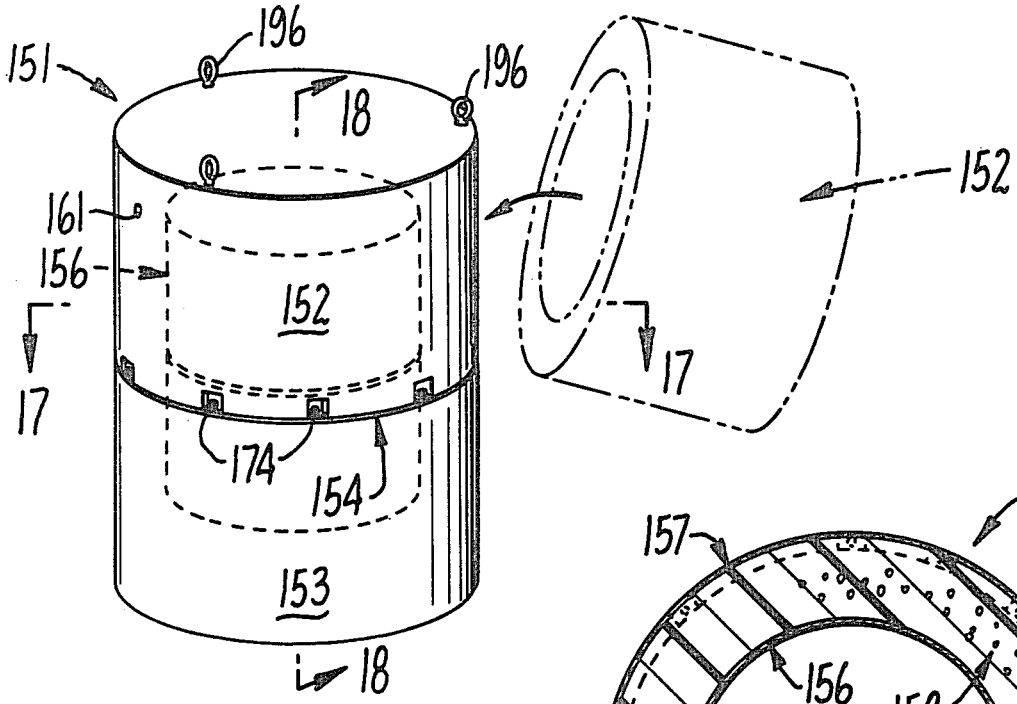
FIG. 16 is a perspective view of a modified form of the shipping container overpack of the present invention and showing removal of a section in phantom lines.
Figure 17:
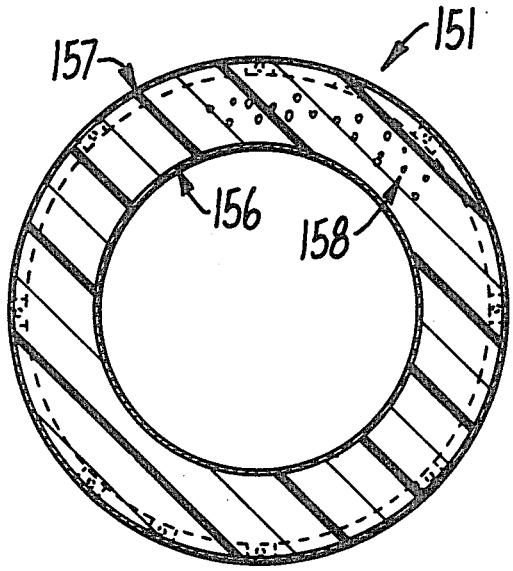
FIG. 17 is an enlarged plan sectional view taken substantially on the plane of line 17—17 of FIG. 16.
Figure 18:
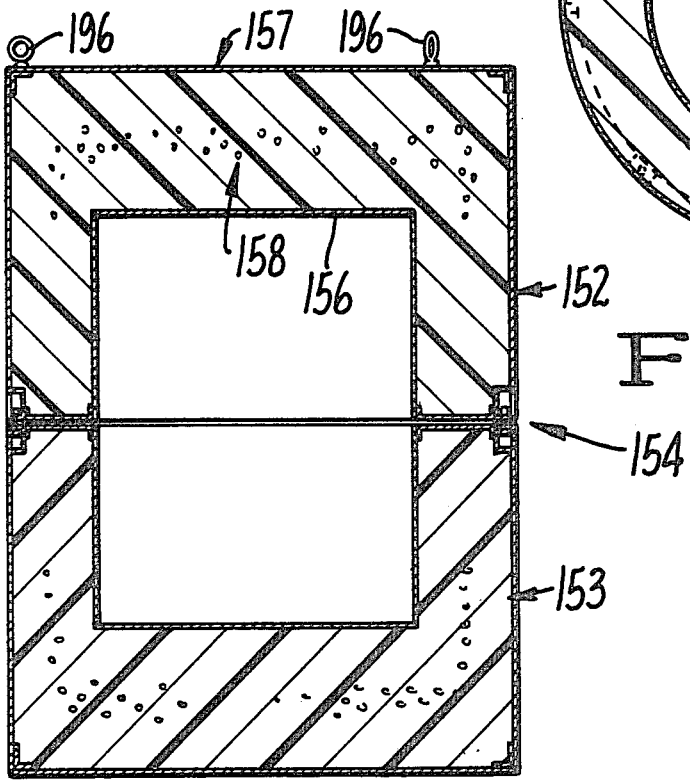
FIG. 18 is an enlarged vertical sectional view taken substantially on the plane of line 18—18 of FIG. 16.

It should be noted that the light-gauge metal plate of the outer shell 57 is easily bowed and bulges as shown in FIG. 14 during the formation of internal pressures due to the generation of gases from heat decomposition of the polyurethane. This separation of the outer shell 57 from the foam 58 forms a highly resistive path for heat flux to enter the receptacle 51. Since the gas separating the outer shell 57 from the undisturbed part of the foam 58 is exiting through the orifices 61, this gas carried much of the heat flux with it to the outside, thus avoiding much of the harmful effect from the excessive heat outside the receptacle 51.

The blowing agent, refrigerant-11, fills the individual cells with non-combustible gas, and the polyurethane foam is preferably fire retardant. The latter characteristic is imparted by adding known fire retardant agents to the liquid mixture.

The extremely light weight of the wall structures, in relation to their strength and the volume they occupy, provides a receptacle which is comparatively light for its size, even when fully loaded. Thus, the fully loaded receptacle 51 may easily be made so it is bouyant in water. This buoyancy further protects the contents against unwanted dispersal, as could occur if the shipping container sank and was breached by deep water pressure, and makes it easier to retrieve the shipping container overpack in the event it falls overboard or its carrier sinks.

The described construction of the wall structures 55, with thin plates 56, 57 and foam 58, provides a shock-insulating action for material being transported. Because of its standardized size and shape, the shipping container overpack of the present invention is particularly suited for transporting items and materials sensitive to shock. For example, radioactive fuel rods are normally provided in the configuration of a long, hollow cylindrical pin, which at times may be only approximately one-fourth of an inch in diameter but often as much as 20 feet long. If accidental shock or even normal road shock is allowed to transfer energy through the shipping container overpack structure to the fuel pins, they could be damaged by fracture of the uranium pellets inside the pins.

In such cases, and for such shock sensitive materials, air springs, here shown in the form of inflated bags 63, may be utilized in the cargo cavity to support and cushion the shock-sensitive cargo. Other known cushioning and restraining devices may also be utilized in the present invention without extensive modification.

In the form of the invention illustrated in FIGS. 1 through 15 of the drawings, the receptacle 51 is formed of generally flat plates in a right rectangular polyhedron configuration similar to that employed for conventional shipping containers of the type commonly called "cargo containers." As here shown, the section 52 is generally of box shape having an open end 64, and the section 53 is formed to provide a removable lid for section 52, lid 53 being swingable between open and closed positions on hinges 66.

The overall dimensions of the receptacle 51 conform to the specifications for standard intermodal cargo containers prescribed by the International Order for Standardization (I.S.O.), being 8 feet wide by 8 feet high by 20 feet long. The inner cavity here is 6 feet high by 6 feet wide by 14 feet long. Universal I.S.O. corner fittings are provided on all eight corners so that the present shipping container overpack can be handled, stored and shipped in the same manner as any standardized cargo container. This provides obvious economic advantages over any system utilizing a nonconventional container.

In the form of the invention illustrated in FIGS. 1 through 15, the shipping container overpack 51 basically consists of two rectangular steel shells 56, 57 separated by rigidly compressible fire-retardant polyurethane foam 58. The outer shell 57 is fabricated from three-sixteenth inch thick low-carbon steel plate, and the inner shell or liner 56 is formed of 10-gauge mild steel. Because of the relatively thin material of the shells, all corners and seams are reinforced to avoid tearing under impact. This reinforcement is provided by lap doubling and continuous seam welding along the overlapping edge, in the manner illustrated in FIG. 6 of the drawings. If additional reinforcement is desired, internal or external angle members 67 are mounted in covering relation to the corners or seams and continuously welded in place; see FIGS. 7 and 8 of the drawings.

Since the corners of the receptacle may be called upon to endure concentrated crushing and tearing stresses, all eight of the corners are here reinforced by caps 67 formed of three-sixteenth inch thick plate welded into place in the manner shown in FIG. 1 of the drawings. The standard I.S.O. fitting castings 68 are preferably supported and secured in place by the corner caps 67.

Figure 11:
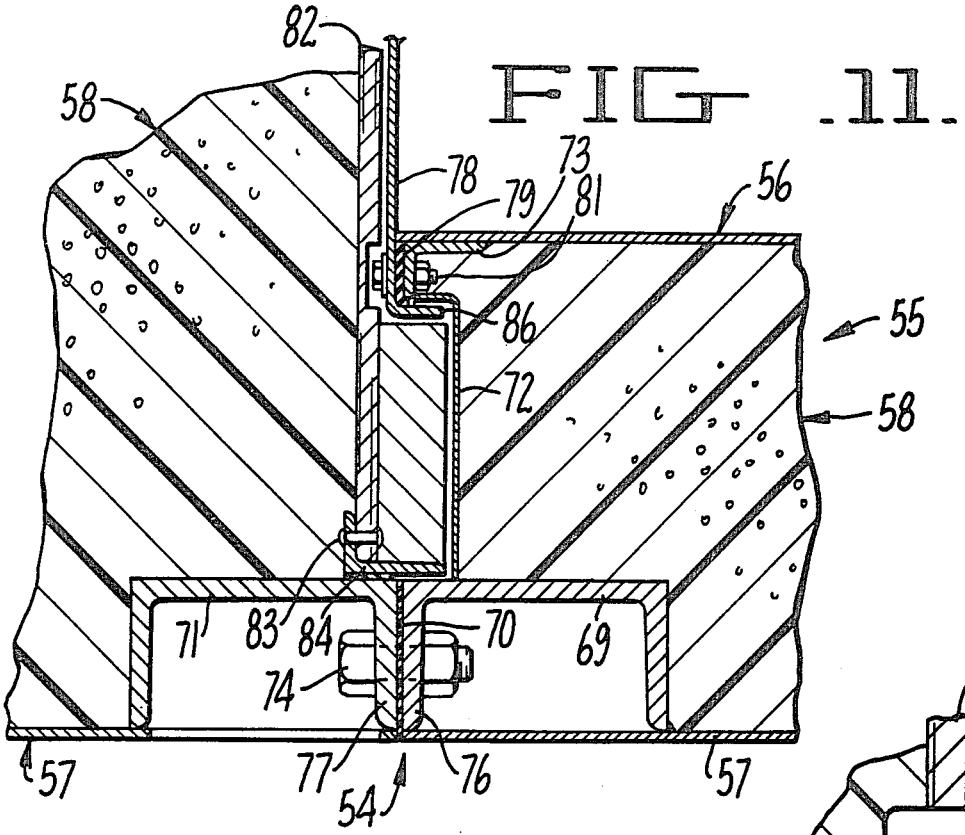
FIG. 11 is a fragmentary sectional view, on an enlarged scale, taken substantially on the plane of line 11—11 of FIG. 4.
Figure 12:
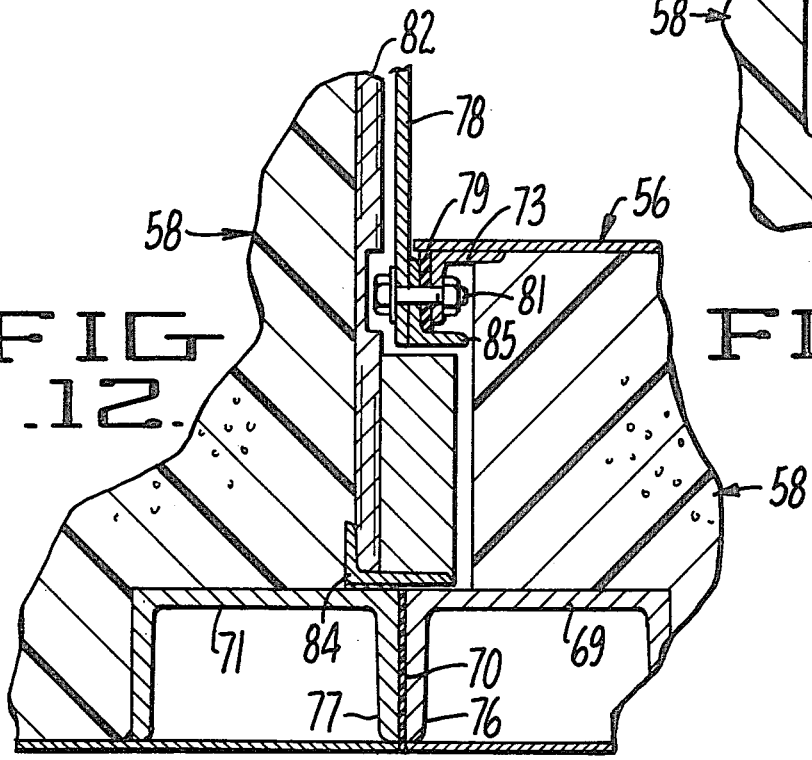
FIG. 12 is a view similar to that of FIG. 11, but illustrating an alternate construction.

As may best be seen in FIGS. 11 and 12 of the drawings, the open end 64 of container section 52 is stabilized and reinforced by a collar frame 69 formed of 6 inch ship channels welded to the inner surface of the outer shell 57. A similar collar frame 71 is provided in lid 53, with collar frame 69 and 71 being aligned in side-by-side relation when lid 53 is in closed position. To provide the means 54 for releasably sealing shut the receptacle 51, the collar frames 69 and 71 are releasably secured together in clamping relation upon a silicone gasket 70 by bolts 74 engaging through adjacent collar frame flanges 76 and 77 respectively. Dowels 75 are provided on lid 53 for engagement in corresponding holes 80 on section 52 to ensure alignment of the bolt holes in channels 76 and 77 and afford easy insertion and removal of the bolts 74.

In the form of the invention shown in FIG. 11, the open end of inner liner 56 is sealed shut to provide the described leak-proof inner liner or shell by a panel 78 removably held in place against a peripheral gasket 79 by bolts 81 releasably engaged through registering openings in panel 78 and member 73. Preferably, the inner layer 82 of the wall structure providing lid 53 is formed of one-half inch thick plywood in order to provide increased protection for lid 53 and to back up panel 78 against shifting of cargo. As shown in FIG. 11, the plywood layer 82 is secured by rivets 83 to an angle iron 84 welded to channel frame 71.

As shown in FIG. 11, the panel 78 is formed with a peripheral flange 86 to strengthen the panel, especially while it is removed. FIG. 12 of the drawings illustrate a somewhat alternate construction in which the peripheral flange effect is provided by an angle iron member 85 welded to a flat panel 78.

Figure 13:
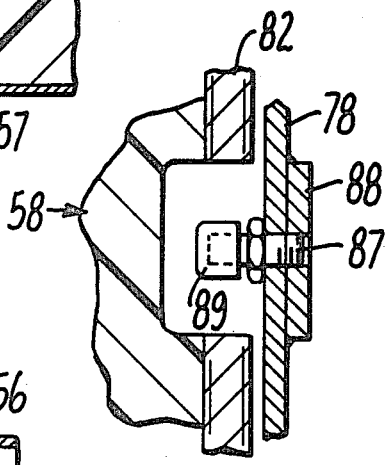
FIG. 13 is a fragmentary sectional detail of a pressure fitting for leak testing.

FIG. 13 illustrates a pressure fitting 87 useful for performing leak tests to make sure the inner liner 56 is leakproof after the cargo is loaded and the panel 78 is in place. As here shown, fitting 87 is threadably engaged through panel 78 and a reinforcing member 88 welded thereto. The distal end 89 of fitting 87 is provided with a suitable cap 91, and the fitting may incorporate a check valve (not shown) of the general type used on automotive tires.

An important feature of the invention, all external edges of the receptacle of FIG. 1 are protected with a diagonal gusset plate 92, here of 12-gauge steel. These gusset plates 92 perform many functions. Should any of the external seam welds fail during impact, the diagonal gusset plate 92 forms not only a redundant load path, but also a secondary seal for the seam. Additionally, by backing all the external edges their entire lengths with the diagonal gussets 92 and filling the triangular cavities formed thereby with the foam material 58, an integral foam stabilized frame is defined, and this frame provides efficient corner columns capable of resisting both compressive and impact loads.

In the event of the entire receptacle landing on one edge, the gusset 92 opposes any tendency of the external skin to spread. This assures a large contact or compressive surface for the energy absorbing foam and helps to maintain the integrity of the receptacle. Using the triangular section provided by the gusset and associated edge as a light tubing, the structure is foamed with a high density polyurethane foam, making this structure very rigid, and providing a redundant oxygen barrier in the event the edge "parts" where the plates forming the ends and/or sides come together. This frame structure also uses the stressed-skin concept for rigidity. In this manner, the entire structure acts in unison, developing a stronger and more rigid structure per unit weight.

As another important feature of the invention, the resistance to penetration of the flat sides of the box-like shipping container overpack 51 is greatly enhanced by the provision of deformable reinforcing plates 93 positioned between an area of the outer shell 57 and the cellular insulating material 58 for further absorbing energy and spreading localized forces so as to resist penetration by an object driven forceably against the outer shell. It has been found that the reinforcing action of the plates 93 is increased very considerably when these plates are releasably secured to the outer shell 57 in such manner as to permit relative slippage between them as the outer shell is subjected to deformation by an object attempting to penetrate the wall structure 55.

The desired securing of the reinforcing plate to the outer shell is accomplished by tack-welding the plate 93 to the inner surface of the outer shell at spaced points around the periphery of the plate. Alternatively, or additionally, the plate 93 can be releasably secured to the outer shell by the adhesion effect provided by the polyurethane foam 58.

In the form of the invention illustrated in FIGS. 16 through 21 of the drawings, the receptacle 151 is formed in a right cylindrical configuration particularly adapted for transporting hazardous materials already enclosed in cylindrical containers. For example, highly radioactive materials are often transported in cylindrical lead casks, and the shipping container overpack 151 may be formed in suitable sizes and configurations to accommodate such casks.

As here shown, the container 151 is transected medially of its length to provide two substantially identical sections 152 and 153 and is provided with means 154 for releasably sealing the sections 152 and 153 together to provide the shipping container overpack. The construction is essentially similar to that of the form of the invention illustrated in FIGS. 1 through 15 of the drawings, in that the receptacle 151 is defined by wall structures 155 having a leak-proof inner liner 156 and a protective outer shell 157, the shells being arranged in concentric spaced relation and having a layer of polyurethane foam 158 disposed in the annular space and adhered to the inner liner 156 and outer shell 157. Vent orifices 161 are provided in the outer shell and function in a manner similar to that previously described in connection with vent orifices 61 of FIG. 1.

Figure 19:
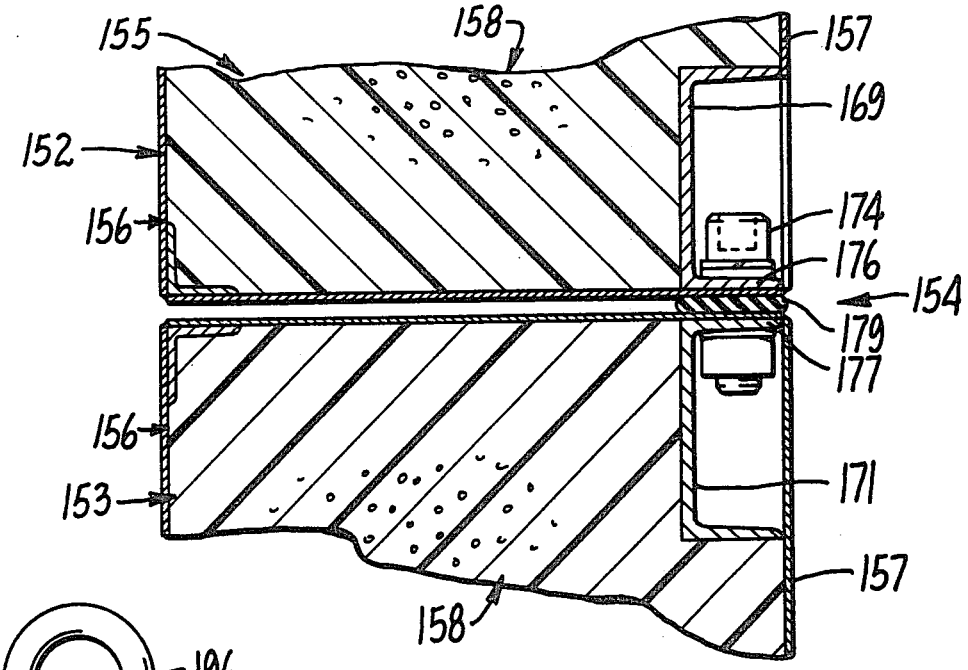
FIG. 19 is an enlarged fragmentary sectional view showing a typical detail of a sealing means forming part of the device of FIG. 16.
Figure 21:
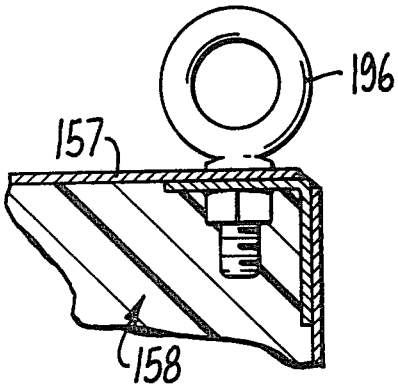
FIG. 21 is an enlarged fragmentary sectional detail view of an upper portion of the device of FIG. 16 incorporating a lifting eye bolt.
Figure 20:
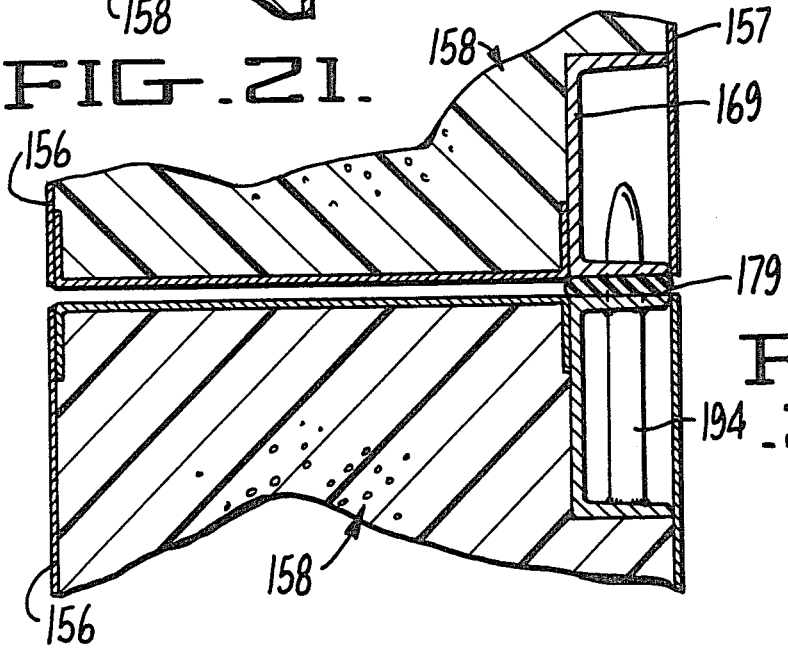
FIG. 20 is a view similar to that of FIG. 19 but illustrating a different portion of the sealing means.

As may best be seen in FIGS. 19 and 20 of the drawings, the open ends of the sections 152 and 153 are reinforced by collar frames 169 and 171, preferably formed of ship channel and welded to the inner surface of the outer shell 157. Bolts 174 releasably secure adjacent flanges 176 and 177 of collar frames 169 and 171 together in clamping relationship around a circumferential gasket 179. Alignment of the flanges 176 and 177 and their bolt holes is facilitated by dowels 194, see FIG. 20. If desired, removable eye-bolts 196 may be provided in the upper end of the container 151, in the manner shown in FIGS. 16 and 21 of the drawings.

From the foregoing it will be apparent that the shipping container overpack of the present invention affords an extremely strong, rigid and very light weight protective receptacle structure adapted for transporting a variety of hazardous materials in a safe and efficient manner, protecting the materials against damage from a wide variety of external causes, and protecting the surrounding environment against accidental dispersal and scattering of hazardous material, such as would be likely to occur in the event of accident to the transporting carrier where less efficient containers are utilized.

We claim:

1. In a shipping container overpack for protected transportation of hazardous materials and the like, a receptacle formed in a plurality of sections, a resilient gasket positionable in sealing engagement between said sections for releasably sealing them together to provide a leakproof overpack, attachment means for operatively engaging and releasably securing said sections together with said gasket positioned in sealing engagement therebetween, at least one of said sections being defined by wall structures, comprising
an inner liner,
an outer shell spaced from said inner liner,
reinforcing plates positioned at the inner surfaces of said outer shell for resisting penetration of said outer shell by external objects and
a layer of foam material sandwiched between and adhered to said inner liner and said outer shell and
wall means joining said inner liner and outer shell to enclose said layer of foam material.

2. In a shipping container overpack, wall structures as described in claim 1 and wherein said inner liner and said outer shell are fabricated of metal, and said layer of foam material is yieldably rigid so as to provide a stress skin structure.

3. In a shipping container overpack, wall structures as described in claim 2 and wherein said receptacle is formed in two sections.

4. In a shipping container overpack, wall structures as described in claim 2 and wherein reinforcing plates are positioned at the inner surfaces of said outer shell for resisting penetration of said outer shell by external objects.

5. In a shipping container overpack, wall structures as described in claim 2 and wherein said outer shell is formed of generally flat plates in a polyhedron configuration, and gusset plates are secured in said outer shell in covering relation along the edges defined by the intersections between contiguous generally flat plates.

6. In a shipping container overpack, wall structures as described in claim 5 and wherein the spaces between said gusset plates and the portions of said flat plates between the gusset plates and associated intersections is filled with a foam material of substantially higher density then said first named layer of foam material.

7. In a shipping container overpack, wall structures as described in claim 5 and wherein said gusset plates and associated flat plates define tubular elements of triangular cross-section, said tubular elements cooperating to provide a reinforcing framework for said outer shell.

8. In a shipping container overpack, wall structures as described in claim 7 and wherein said tubular elements are filled with high density foam material adhered to the inner surfaces of said tubular elements and substantially reinforcing said framework.

9. In a shipping container overpack, wall structures as described in claim 3 and wherein one of said sections is of box shape having an open end, and the other of said sections is substantially flat to provide a lid for said first named section.

10. A shipping container overpack for safe transportation of hazardous materials and the like, comprising
a leak proof receptacle adapted to contain and protect the material to be shipped against release in the event of accident such as to subject said overpack to excessive thermal and impact conditions and including a laminated wall structure having relatively dense and tough inner and outer layers adhered opposite sides of a layer of foamed polyurethane with said outer layers formed with orifices for expulsion of gases emanating from said foamed polyurethane when said receptacle is subjected to excessive thermal conditions,
said receptacle having a body portion and a lid portion, and means for releasably sealing said body portion to said lid portion.

11. In a shipping container overpack, wall structures as described in claim 10 and wherein said foam material provides thermal insulation, and said orifice is sealed shut by heat and pressure responsive means formed to unseal and open said orifices when pedetermined temperatures and internal pressures are reached.

12. In a shipping container overpack, wall structures as described in clain 11 and wherein said heat and pressure responsive means comprises a heat degradable plug mounted in said orifice.

13. In a shipping container overpack, wall structures as described in claim 12 and wherein said plug is formed of thermoplastic.

14. A shipping container overpack as described in claim 10 and wherein said laminated wall structure comprises relatively dense and tough layers adhered to opposite sides of a less dense and tough layer of rigidly compressible insulating material to provide a stress skin structure, and wherein said relatively dense and tough layers are formed of metal, and said layer of insulating material is substantially non-metallic.

15. An overpack for shipping hazardous materials, comprising
a receptacle for confining the material to be shipped against accidental exposure and scattering,
said receptacle having spaced inner and outer shells of ductile material with said outer shells formed with angular intersections between adjacent surfaces,
a rigidly compressible first mass of insulating material filling the space between said inner and outer shells,
lid means for providing access to the interior of said receptacle for loading and removing of the material being shipped,
reinforcement means comprising diagonal gusset plates secured to adjacent sections of said outer shell and extending along said intersections with a second mass of insulating material formed in the spaces between said gusset plates and the associated intersections for providing further reinforcement,
and a deformable reinforcing plate positioned between said outer shell and said insulating material for further absorbing energy and spreading localized forces so as to resist penetration by an object.

16. An overpack as described in claim 15 and wherein said reinforcing plate is releasably secured to said outer shell whereby relative slippage can occur as said outer shell is subjected to deformation.

17. An overpack as described in claim 16 and wherein securing of said reinforcing plate to said outer shell is afforded by adhesion of said first mass of insulating material thereto.

18. An overpack as described in claim 16 and wherein said reinforcing plate is releasably secured to said outer shell by tack welding.

19. An overpack as described in claim 15 and wherein said insulating material is a continuous layer of foam polymer adhered to said shells, said foam polymer consisting of polyurethane.

20. An overpack as described in claim 19 and wherein said layer of foam polymer is of greater density at said shells than remote therefrom.

21. An overpack as described in claim 15 and wherein said receptacle is of box like configuration and formed in two sections with one of said sections defining a container and the other of said sections defining said lid, and hinges securing said lid section to said container section for swinging movement between open and closed positions.

22. A protective shipping container for hazardous materials, comprising a rectangular metal outer shell of standardized shipping container size and shape and having standard corner fittings, a continuous layer of relatively rigid fire retardant polyurethane foam adhered to the inner surfaces of said outer shell, a rectangular metal inner lining shell positioned within said layer and adhered thereto, a plurality of slip plates releasably secured to the inner flat surfaces of said outer shell, a plurality of elongated gusset plates having their edges secured to the inner flat surfaces of said outer shell in diagonally covering relation to the intersections of said flat surfaces, one end of said container being formed to provide a movable lid, said outer and inner shells being connected to each other at said lid to seal off said layer of foam, hinges on said container supporting said lid for swinging movement between open and closed positions, gasket means sealing said lid to the rest of said container when in said closed position, reinforcing members inset in said lid and the confronting rim of the container, bolt means releasably engageable in said reinforcing members for holding said lid in said closed position, and orifices formed through said outer shell to permit egress of gases from said foam layer.

23. In a shipping container overpack for protected transportation of hazardous materials and the like, a receptacle formed in a plurality of sections;

means associated with said sections for releasably sealing them together to provide a leakproof overpack;

said sections being defined by wall structures, comprising an inner liner, an outer shell spaced from said inner liner, and a layer of foam material sandwiched between and adhered to said inner liner and said outer shell, said layer of foam material being substantially free of voids at and adjacent to said liner and said shell and having gradually increasing numbers of voids from the vicinity of said liner and shell to the area midway therebetween, said inner liner and said outer shell being fabricated of metal, said layer of foam material being yieldably rigid so as to provide a stress skin structure in conjunction with said liner and shell, said layer of foam material being foamed in situ between the fabricated inner liner and outer shell to provide said gradually increasing numbers of voids therein, said layer of foam material being formed of an isocyanate mixed with an exothermic curing agent and a blowing agent capable of vaporizing under the exothermic heat of said curing agent and not vaporizing under the chilling influence of said metal liner and shell so as to provide said gradually increasing numbers of voids, said curing agent being a polyol, and said blowing material comprising trichloromonofluormethane.

24. In a shipping container overpack for protected transportation of hazardous materials and the like, a receptacle formed in a plurality of sections;

means associated with said sections for releasably sealing them together to provide a leakproof overpack;

said sections being defined by wall structures, comprising a metal inner liner of substantial thickness, a metal outer shell of substantial thickness spaced from said inner liner, and a layer of foam material sandwiched between and self adhered to said inner liner and said outer shell, said layer of foam material being substantially free of voids at and adjacent to said liner and said shell and having gradually increasing numbers of voids from the vicinity of said liner and shell to the area midway therebetween;

and wherein said layer of foam material is yieldably rigid so as to provide a stress skin structure in conjunction with said liner and shell;

and wherein said receptacle is formed in two sections, said inner liner and said outer shell are joined together by a metal wall to enclose said layer of foam material within each section, said means comprises a resilient gasket positionable in sealing engagement between said sections, and attachment means is provided for operatively engaging and releasably securing said sections together with said gasket positioned in sealing engagement therebetween;

and wherein said foam material provides thermal insulation, said outer shell is formed with an orifice for expulsion of gases emanating from said foam material when said receptacle is heated excessively as by a surrounding fire, and said orifice is sealed shut by heat and pressure responsive means formed to open and unseal said orifices when predetermined temperatures and internal pressures are reached.

25. In a shipping container overpack for protected transportation of hazardous materials and the like, a receptacle formed in a plurality of sections;

means associated with said sections for releasably sealing them together to provide a leakproof overpack;

said sections being defined by wall structures, comprising a metal inner liner of substantial thickness, a metal outer shell of substantial thickness spaced from said inner liner, and a layer of foam material sandwiched between and self adhered to said inner liner and said outer shell, said layer of foam material being substantially free of voids at and adjacent to said liner and said shell and having gradually increasing numbers of voids from the vicinity of said liner and shell to the area midway therebetween;

and wherein said layer of foam material is yieldably rigid so as to provide a stress skin structure in conjunction with said liner and shell;

and wherein said outer shell is formed of generally flat plates in a polyhedron configuration, and gusset plates are secured to said outer shell in the space between said inner liner and outer shell in covering relation along the edges defined by the intersections between contiguous generally flat plates;

and wherein spaces are formed between said gusset plates and the portions of said flat plates between the gusset plates along the associated intersection, and said spaces are filled with a foam material of substantially higher density than said first-named layer of foam material.

26. In a shipping container overpack, wall structures as described in claim 24 and wherein heating of said foam material above a predetermined temperature generates an inflammable gas, and said orifice is formed for expulsion of said gas therethrough with sufficient velocity that combustion occurs a spaced distance from said outer shell.

27. In a shipping container overpack, wall structures as described in claim 25 and wherein said gusset plates and associated flat plates define hollow tubular elements of triangular cross section, said tubular elements cooperating to provide a reinforcing framework for said outer shell.

28. In a shipping container overpack, wall structures as described in claim 27 and wherein said tubular elements are filled with high density foam material adhered to the inner surfaces of said tubular elements and substantially reinforcing said framework.

* * * * *